US005911563A

United States Patent [19]

Duppert et al.

[11] Patent Number: 5,911,563

[45] **Date of Patent: *Jun. 15, 1999**

[54] AIR CONDITIONING BLOWER MOTOR ASSEMBLY WITH IMPROVED ACCESSIBILITY

[75] Inventors: Ronald J. Duppert, East Syracuse, N.Y.; Joe W. Dark; John W. Schedel, both of Tyler, Tex.; Bradley L. Kersh, Flint, Tex.; Eugene D. Daddis, Jr., Nedrow; Benny P. Dimarco, Cicero, both of N.Y.

[73] Assignee: Carrier Corporation, Syracuse, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,050

[22] Filed: Dec. 23, 1996

Related U.S. Application Data

[63] Continuation of application No. 08/723,268, Sep. 30, 1996, abandoned.

[51] Int. Cl.[6] ..... F04B 17/00

[52] U.S. Cl. ..... 417/360; 417/361; 417/423.15; 310/91; 62/428

[58] Field of Search ..... 417/360, 423.15, 417/423.14, 361, 363, 423.1, 423.2; 416/244 R, 247 R; 415/182.1, 183; 248/215, 519, 676, 678; 310/91, 51; 62/426, 428

[56] References Cited

U.S. PATENT DOCUMENTS

| | | | |
|---|---|---|---|
| 1,611,381 | 12/1926 | Salsbury | 310/91 |
| 2,063,682 | 12/1936 | Johnson | 417/368 |
| 2,331,958 | 10/1943 | Breese et al. | 417/360 |
| 2,345,516 | 3/1944 | Weber | 416/247 |
| 2,359,051 | 9/1944 | Roper | 62/428 |
| 2,954,193 | 9/1960 | Loftis | 310/51 |
| 3,154,242 | 10/1964 | Harris | 417/361 |
| 3,343,016 | 9/1967 | Lewis | 310/51 |
| 3,926,537 | 12/1975 | Pipler | 417/360 |
| 3,960,063 | 6/1976 | Siemes et al. | 417/360 |
| 4,394,111 | 7/1983 | Wiese et al. | 417/360 |
| 4,443,965 | 4/1984 | Gie | 416/247 R |
| 4,502,291 | 3/1985 | Shelton et al. | 417/360 |
| 4,554,796 | 11/1985 | Stankard | 62/428 |
| 4,565,075 | 1/1986 | Drucker et al. | 415/182.1 |
| 4,849,667 | 7/1989 | Morrill | 310/91 |
| 4,978,281 | 12/1990 | Conger | 417/423.15 |
| 5,492,456 | 2/1996 | Knight et al. | 417/423.15 |

OTHER PUBLICATIONS

Grainger, industrial and commercial eqipment and supplies, General Catalog No. 380, p. 2127, item No. 3M872, 1991.

*Primary Examiner*—Timothy S. Thorpe
*Assistant Examiner*—Ted Kim

[57] ABSTRACT

The invention is a blower assembly for a packaged climate control unit such as a packaged air conditioning or heating unit. An orifice ring for receiving and guiding rotation of a blower wheel of the assembly is made detachable so that the wheel can be inserted into and retrieved from the top of the blower assembly housing. Further, the blower assembly may comprise an improved motor stand having vertically oriented pegs which are received by receptacles formed about the outer surface of the motor. When the assembly is installed in packaged unit having a detachable top section, both the blower wheel and the blower wheel motor can be retrieved from the packaged unit for servicing or replacement without removing the blower assembly housing from the packaged unit.

7 Claims, 2 Drawing Sheets

AIR CONDITIONING BLOWER MOTOR ASSEMBLY WITH IMPROVED ACCESSIBILITY

This application is a continuation of application Ser. No. 08/723,268, filed Sep. 30, 1996, now abandoned.

BACKGROUND OF THE INVENTION

1. Field of the Invention

The present invention relates to air conditioning units in general, and specifically to an improved blower assembly for a packaged climate control unit.

2. Background of the Prior Art

Ground-mounted or roof-mounted climate control units for light industrial or residential use, commonly known as "packaged" climate control units include a containment system for containing the internal components thereof. Packaged climate control units can include, for example, packaged air conditioning units, packaged heat pumps, packaged heating units, and year-round combinational packaged air conditioning and heating units. Given the numerous sensitive internal components of such units, the containment system must repeatedly be partially disassembled and assembled to allow for servicing, maintenance, or replacement of these sensitive internal components.

The conventional containment system for a packaged climate control unit does not allow for easy access to component parts, which have to be routinely serviced or replaced.

One component that is particularly difficult to access in a conventional packaged climate control unit is the blower assembly which includes a blower motor and associated blower wheel. In known packaged climate control units the blower motor and wheel are attached to a blower housing. The blower motor and wheel can be accessed for servicing or replacement only by first removing the entire blower assembly from the unit cabinet. Once the assembly is removed from the packaged unit, several components of the assembly have to be detached to allow access to major components of the assembly such as the blower wheel and blower motor.

There exists a need for a mounting apparatus and method for mounting a blower assembly in a packaged climate control unit which facilities simplified access and removal of a blower assembly and the component parts thereof.

SUMMARY OF THE INVENTION

According to its major aspects and broadly stated, the present invention is an improved unit blower assembly. The improved blower assembly facilitates simplified retrieval of blower assembly component parts for servicing or replacement.

The blower assembly of the present invention includes a housing which is adapted for rigid attachment to an unit cabinet such that the housing interior is in fluid communication with a unit inlet duct and an outlet duct. The housing interior includes a blower with a receiving port for receiving a blower wheel which is disposed to draw in air from the inlet duct and direct such air outward over the unit's cooling coil and through the unit's outlet duct. In the present invention, the top of the blower wheel is received in a specially configured orifice ring. So that it receives the blower wheel, the orifice ring must have an interior diameter smaller than that of the wheel.

The orifice ring in the present invention is configured to be removably attachable to the blower assembly. As such, the detachable orifice ring allows for vastly simplified retrieval and servicing of blower assembly components. In the present invention, a blower wheel can be accessed for servicing or replacement simply by removing the detachable orifice ring from the blower assembly housing, and lifting the wheel vertically upwardly after detaching the wheel from the blower wheel motor axle. In a standard prior art arrangement, by contrast, the entire blower assembly has to be removed from the packaged unit in order to access a blower wheel.

The blower assembly of the present invention further includes an improved motor receiving apparatus, or motor mount. The motor receiving apparatus of the invention includes a plurality of legs which are all connected about a central hub. Each leg terminates in a vertically oriented peg. Formed about the outer periphery of the motor, meanwhile, are a plurality of peg receptacles which are adapted to receive the vertically oriented pegs. A motor is mounted to the motor mount by installing the motor over the legs so that each peg receptacle is received in a vertically oriented peg. Each peg may include a nut which is threaded about a threaded end formed about an end of each peg. Tightening a nut urges a flange formed on each peg tightly against a receptacle to tightly adjoin a peg and a receptacle.

A major advantage of the improved motor stand is that the motor can be removed from the mount simply by loosening the nuts threaded on each peg, and lifting the motor upward. Whereas prior art motor mounts require that a wrench, screw, or nutdriver be inserted quite awkwardly into the packages unit to facilitate motor removal, the nuts of the present motor mount, threaded on vertically oriented pegs, can be accessed by rotating a nut driver that is vertically oriented with respect to the packaged unit.

These and other features and advantages of the present invention will become clear to the skilled artisan from a reading of the ensuing Detailed Description in connection with the referenced drawings.

BRIEF DESCRIPTION OF THE DRAWINGS

In the drawings, wherein like numerals are used to indicate the same elements throughout the views.

DETAILED DESCRIPTION OF THE PREFERRED EMBODIMENTS

The major features and advantages of the present invention are best understood and appreciated by first examining a standard packaged climate control unit having a standard blower assembly design.

Figure 1:
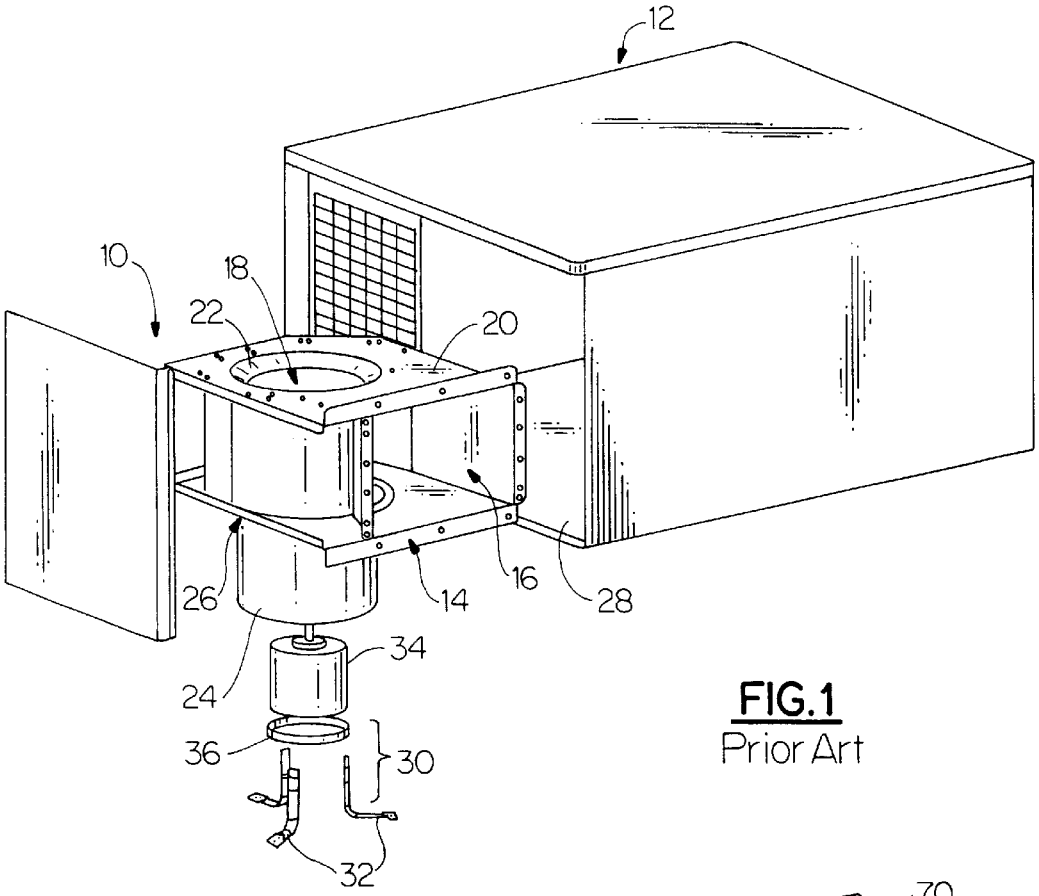
FIG.1 Prior Art
FIG. 1 is a perspective installation detail of a prior art packaged climate control unit and blower assembly.

A blower assembly 10 according to a standard design in a standard packaged unit 12 is shown in FIG. 1. Blower assembly 10 includes blower housing 14 having an open section, or interior 16 partially defined by blower wheel receiving port 18. When assembly 14 is installed in packaged unit 12 open section 16 is in fluid communication between an inlet air duct and an outlet air duct (both not shown).

Formed at top 20 of blower housing 14 is an orifice ring 22 for receiving and guiding the rotation of blower wheel 24. In the prior art, orifice ring 22 is fixedly formed (either during the formation process or by welding) on housing 14 to extend downward from top 20. A requirement of ring 22 is that ring 22 have an interior diameter smaller than that of the wheel 24 which is adapted to receive. As such, in the prior art design, wheel 24 can only be installed or retrieved in assembly housing 14 by inserting or retrieving wheel 24 through the bottom end 26 of wheel receiving port 18. Because the distance between the blower housing bottom and the base pan 28 of packaged unit 12 is less than the height of the wheel, a blower wheel 24 of a prior art design can be retrieved for servicing or replacement only by detaching the entire blower housing 14 from packaged unit 12.

It is seen further that motor mount 30 of the prior art design includes a plurality of legs 32 for installation on base pan 28 which are spaced apart to abut or nearly abut motor 34 when motor is inserted in an area defined by legs 32. Motor 34 is firmly secured to legs 32 by tightening hose clamp 36 which is disposed about legs 32. A problem with the mount device utilizing a hose clamp is that hose clamp 36 can be conveniently tightened only by rotating a screwdriver or nut driver that is oriented horizontally with respect to the packaged unit 12.

Figure 3:
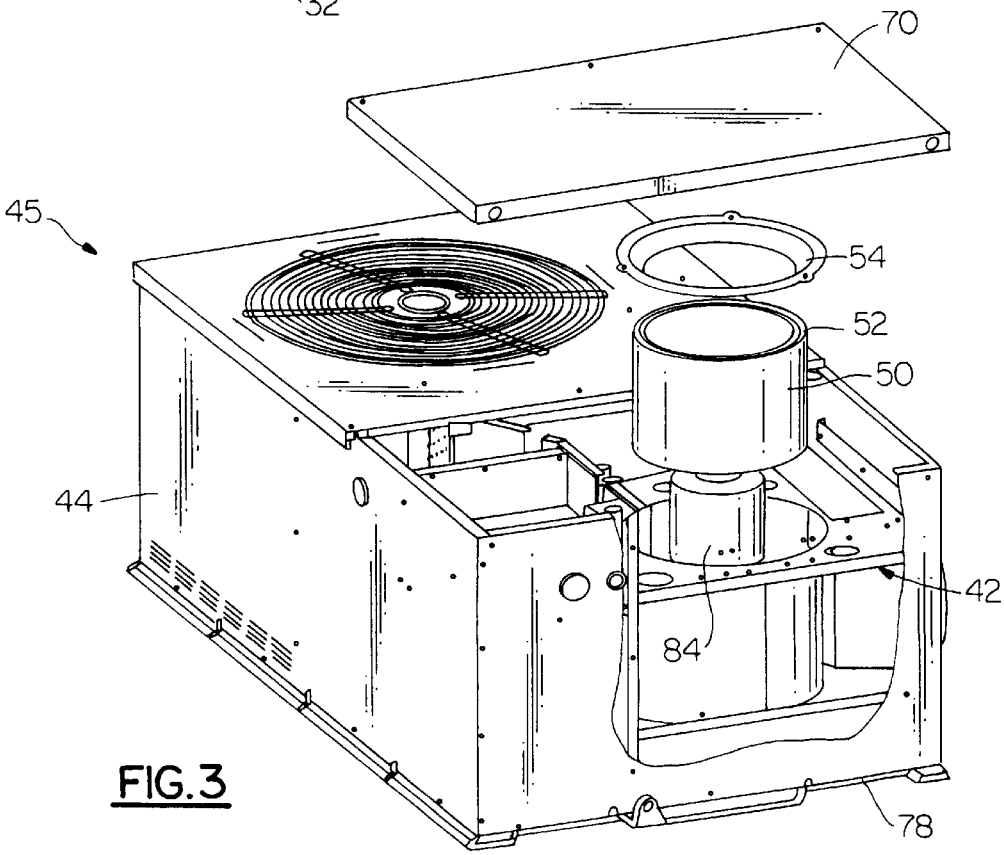
FIG. 3 is a perspective installation detail of a climate control unit and blower assembly according to the invention.
Figure 2:
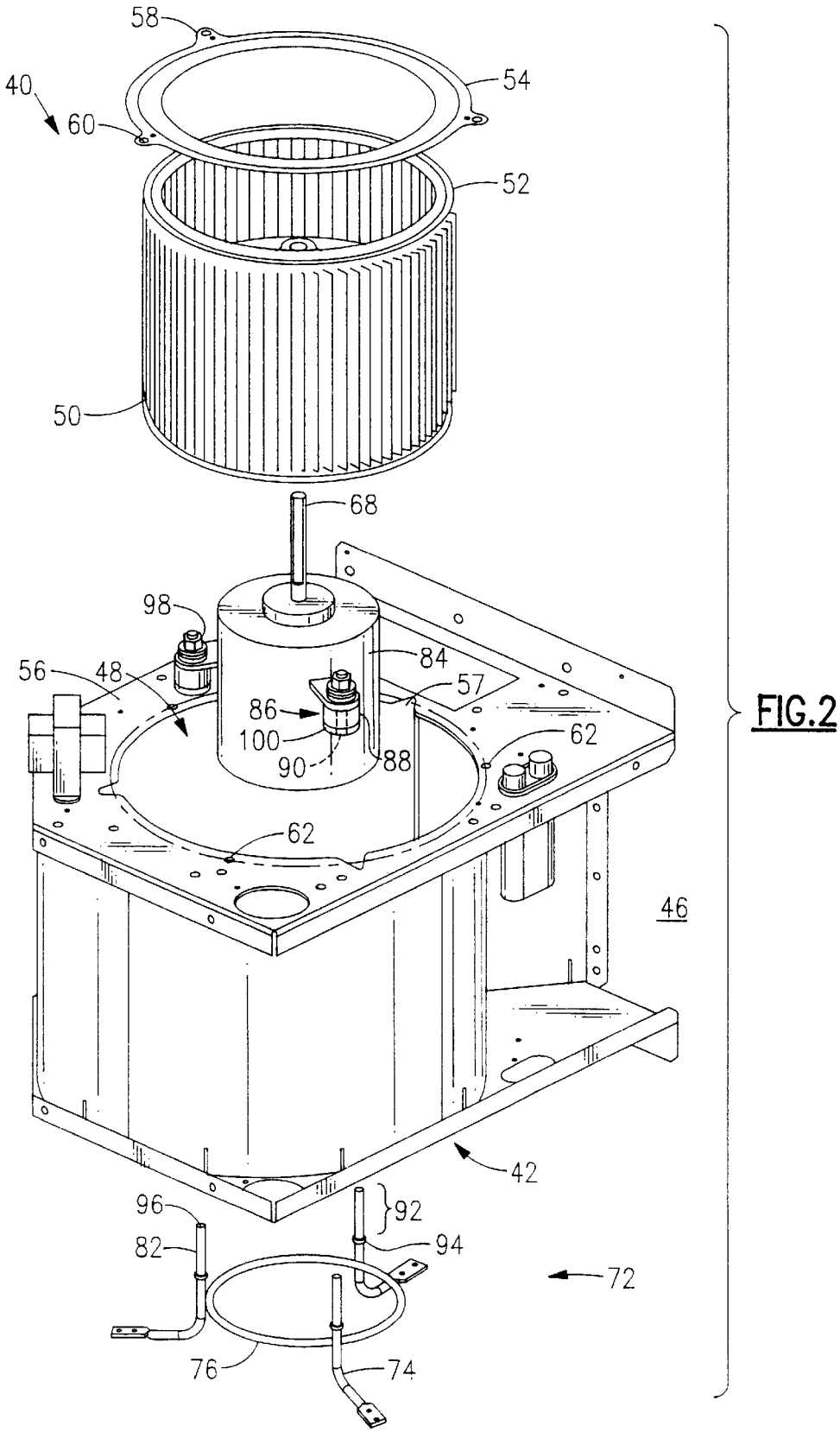
FIG. 2 is a perspective assembly detail of a blower assembly according to the invention.

An improved blower assembly according to the present invention is shown in FIGS. 2 and 3. Like the prior art blower assembly, the present assembly 40 includes a blower housing 42 which is adapted for attachment to an unit cabinet 44 such that housing interior or opening 46 is in fluid communication with a unit inlet duct and an outlet duct. Opening 46 is partially defined by a wheel receiving port 48 for receiving a blower wheel 50. In general, blower wheel 50 draws in air from an inlet duct and directs such air outward over the unit's cooling coil and through the unit's outlet duct. While blower assembly housing 42 may be formed of virtually any rigid material it is customarily formed by sheet metal.

According to the present invention, upper rim 52 of blower wheel 50 is received in a specially configured orifice ring 54. Specifically, orifice ring 54 of the present invention is configured to be removably attached to the blower housing top 56. In one embodiment, as best seen in FIG. 2, orifice ring 54 includes a plurality of tabs 58 formed about its periphery, each having a bolt hole 60. Orifice ring 54 may be formed by a punch out process wherein ring 54 is punched out from a sheet metal member used in making assembly housing top 56. When ring 54 is made by a punch out process, notches 57 are left in housing top 56. To attach the orifice ring to the blower housing, screws or bolts are driven through holes 60 of ring 54 and complementary holes 62 formed in housing top 56. If orifice ring 54 is not made by a punch out process it is not necessary to provide tabs 58 for increasing the effective diameter of ring 54. Instead, ring 54 will be made to have a larger outer diameter than an inner diameter of wheel receiving port 48 to allow simplified attachment of ring 54 to housing 42.

Removably attached orifice ring 54 allows for vastly simplified retrieval and servicing of blower assembly components. In the present invention, blower wheel 50 can be accessed for servicing or replacement simply by removing the detachable orifice ring 50 from the blower assembly housing 42, and lifting the wheel vertically upwardly after detaching the wheel from the blower wheel motor axle 68.

The advantages of the present blower assembly design are best realized when the assembly is installed in a packaged unit having a detachable top section 70 as shown in FIG. 3. When installed in a packaged unit having a detachable top section the present blower assembly allows for retrieval of blower assembly component parts without requiring removal of blower assembly housing 42 from cabinet 44 of the packaged unit 45 as in the prior art design. In FIG. 3 showing a packaged unit having a detachable top, it can be seen that blower wheel 50 can be retrieved from unit 45 without any detaching of housing 42 from cabinet 44. Blower wheel 50 is retrieved simply by removing top section 70 from cabinet 44, detaching orifice ring 54 from housing top 56, loosening a set screw (not shown) which secures wheel 50 to motor axle 68 and lifting blower wheel 50 from axle 68 and out of the packaged unit.

The blower assembly of the present invention may further include an improved motor receiving apparatus, or motor mount 72. Improved motor mount 72 includes a plurality of legs 74 which are all connected about a central hub 76. Central hub 76 is provided to support legs and to space legs 74 in predetermined positions in relation to one another. In the alternative, central hub 76 can be deleted and legs 74 can be rigidly installed on base pan 78 in precise positions with respect to one another, similar to the arrangement shown of legs 32 in the prior art assembly or FIG. 1.

Each leg terminates in a vertically oriented peg 82. Formed about the outer periphery of motor 84, meanwhile, are a plurality of peg receptacles 86 which are adapted to receive the vertically oriented pegs 82. Motor is mounted to mount 72 by installing the motor over the legs so that each peg receptacle is received in a vertically oriented peg 82.

In one embodiment of the invention, each receptacle includes a member 88 having a vertically oriented hole 90. Each peg, meanwhile, has threads 92 formed an effective distance along its length, and further comprises a stopper flange 94 formed a predetermined distance from a tip 96 thereof. Threaded end 92 of each peg 82 extends through hole 90 of each receptacle when receptacles 86 are fitted onto pegs 82. Tightening a nut threaded on a threaded peg end 82 urges flange 94 tightly against a receptacle bottom to tightly adjoin a peg and a receptacle.

A major advantage of the improved motor stand is that motor 84 can be removed from the mount 72 simply by loosening the nuts threaded on each peg, and lifting the motor vertically upward. Whereas prior art motor mounts require that the wrench, screw, or nut driver be inserted quite awkwardly into the packaged unit to facilitate motor removal, the nuts of the present motor mount, threaded on vertically oriented pegs, can be accessed by rotating a nut driver that is vertically oriented with respect to the packaged unit. It will be appreciated that access to the motor mount bolts with a vertically oriented nut or screw driver greatly simplifies the process of removing a blower motor from unit 45 for servicing or replacement.

Like the detachable orifice ring feature, the improved motor mount feature is most advantageous when a blower assembly having an improved motor mount is installed in a packaged unit having a detachable top 70, as is shown in FIG. 3. When installed in packaged unit having a detachable top, the improved motor mount feature enables motor 84 to be removed from a packaged unit without any disturbance of blower assembly housing 42.

A blower motor is removed from a packaged unit having a detachable top section 70 and a removable orifice ring 54 by removing detachable top 70, removing detachable orifice ring 54, removing blower wheel 50 from motor axle, loosening nuts 98 from vertically oriented threaded pegs 82 then lifting motor upward through blower wheel receiving port 48 and out of packaged unit 45. It would be much more difficult to remove a motor mounted on a prior art motor mount 30 since the prior art motor mount requires a horizontal orientation of a screw or nut driver for loosening of hose clamp nut of hose clamp 36 which clamps legs 32 about motor 34.

While the present invention has been described with reference to a number of specific embodiments, it will be understood that the spirit and scope of the present invention should be determined with reference to the appended claims.

What is claimed is:

1. A packaged climate control unit comprising:

an outer casing having a detachably removable cover section; and a blower assembly disposed under said detachably removable cover section, said blower assembly having a housing having an outer wall with a cutaway section defining a blower wheel receiving port;

a blower wheel disposed in said housing, said blower wheel having a diameter smaller than that of said receiving port;

an orifice ring having an inner diameter smaller than said blower wheel diameter and being removably attached directly to said housing outer wall so as to retain said blower wheel in said housing but allow removal therefrom by removing said orifice ring from said outer wall and removing said blower wheel from said receiving port; and motor means for driving said blower wheel, said motor means being drivingly connected to said blower wheel on its side opposite to that of said orifice ring.

2. The climate control unit of claim 1, wherein said attachment means comprises a plurality of vertically oriented bolts driven through said orifice ring and received in said housing top.

3. The climate control unit of claim 1, further comprising a motor mount for receiving said motor means, said motor mount including:

a central hub;

a plurality of legs disposed on said central hub, each leg terminating in a vertically oriented peg;

a plurality of peg receiving means attached to an outer housing of said motor means, each peg receiving means receiving one of said pegs.

4. The climate control unit of claim 1, further comprising a motor mount for receiving said motor means, said motor mount including:

a central hub;

a plurality of legs disposed on said central hub, each leg terminating in a peg;

a plurality of peg receiving means attached to an outer housing of said motor means, each peg receiving means receiving one of said pegs; and connecting means at least partially formed on each of said peg receiving receptacles, for detachably connecting one of said receptacles to one of said pegs.

5. A method for disassembling a blower wheel assembly disposed in a packaged climate control unit, said method comprising the steps of:

providing a detachable cover section for said unit;

providing a housing having an outer wall with a cutaway section defining a blower wheel receiving port having a diameter larger than the diameter of a blower wheel to be contained within said housing;

providing an orifice ring removably attached directly to said housing outer wall and having an inner diameter smaller than the outer diameter of said blower wheel;

removing said cover section;

disconnecting said orifice ring from said housing outer wall to provide access to said blower wheel; and extracting said blower wheel from said blower wheel receiving port of said blower assembly.

6. The method of claim 5, wherein said disconnecting step includes the step of unscrewing bolts or screws connecting said orifice ring from said blower assembly.

7. The method of claim 5, further comprising the steps of:

before said removing step, providing a blower motor for driving said blower wheel;

before said removing step, providing a motor mount for mounting said blower motor;

after said extracting step, loosening said blower motor from said motor mount; and lifting said blower motor from said motor mount through said blower wheel receiving port, and out of said assembly.

* * * * *